US006720875B2

(12) United States Patent
Philippe

(10) Patent No.: US 6,720,875 B2
(45) Date of Patent: Apr. 13, 2004

(54) SELF-ADJUSTING ALARM DEVICE WITH LOW ENERGY CONSUMPTION

(75) Inventor: François Philippe, Juan les Pins (FR)

(73) Assignee: F and F International S.A.R.L., Tunis (TN)

( * ) Notice: Subject to any disclaimer, the term of this patent is extended or adjusted under 35 U.S.C. 154(b) by 0 days.

(21) Appl. No.: 10/276,612

(22) PCT Filed: May 18, 2001

(86) PCT No.: PCT/FR01/01541

§ 371 (c)(1),
(2), (4) Date: Nov. 18, 2002

(87) PCT Pub. No.: WO01/88870

PCT Pub. Date: Nov. 22, 2001

(65) Prior Publication Data

US 2003/0156031 A1 Aug. 21, 2003

(51) Int. Cl.[7] ..... G08B 13/20; G08B 13/08

(52) U.S. Cl. ..... 340/541; 340/544; 340/545.1; 116/4

(58) Field of Search ..... 340/541, 426.1, 340/544, 545.4, 545.9; 116/4, 5, 6, 86

(56) References Cited

U.S. PATENT DOCUMENTS 5,084,696 A 1/1992 Guscott et al. ..... 340/541
5,705,985 A 1/1998 Studach ..... 340/566
5,796,336 A * 8/1998 Ishino et al. ..... 340/566

FOREIGN PATENT DOCUMENTS

| | | | |
|---|---|---|---|
| EP | 0 159 218 | 10/1985 | ..... G08B/13/16 |
| FR | 2694650 | 2/1994 | ..... G08B/13/16 |
| FR | 2770670 | 5/1999 | ..... G08B/13/22 |

* cited by examiner

*Primary Examiner*—Jeffery Hofsass
*Assistant Examiner*—Jennifer Stone
(74) *Attorney, Agent, or Firm*—James C. Lydon

(57) ABSTRACT

An alarm device including an acoustic pressure sensor (10) delivering an analog signal to first amplifying means (12) and to second amplifying means (14), a first comparator (34) where the positive input is connected to the output of the second amplifying means and where the output delivers a warning signal to alarm means (26, 28) when there is a break-in or an attempt at breaking in, and self-adjusting means including a microprocessor (26) programmed to deliver a digital signal at the negative input of the first comparator where the pulses have a variable width which increases in accordance with the duration and the importance of the atmospheric disturbance so as to automatically increase the alarm device triggering threshold and reduce its sensitivity when the acoustic sensor detects an atmospheric disturbance such as wind.

10 Claims, 2 Drawing Sheets

SELF-ADJUSTING ALARM DEVICE WITH LOW ENERGY CONSUMPTION

This application is a U.S. National Stage of International application PCT/FR01/01541, filed May 18, 2001 and published on Nov. 22, 2001 in the French Language.

TECHNICAL FIELD

This invention concerns alarm devices which are able to detect differences in acoustic pressure following the untimely opening or break-in of a door or window and specifically concerns a self-adjusting alarm device with low power consumption.

BACKGROUND ART

In alarm devices of this type, the output signal from a microphone is first amplified, then, generally, compared to a reference voltage set in a comparator whose output may have two possible states depending on the relative value of the signal received from the microphone and the reference voltage.

These devices trip the alarm as a result of an aperiodic compressional wave, although they remain in sensitive to a periodic signal such as an audible sound, with monitoring of namely the shape and amplitude of the signals received.

In the majority of devices of previous art designed to warn of the untimely opening of doors and windows in a closed room, threshold sensitivity must be adjusted manually on a case by case basis.

In practice, this adjustment is closely linked to possible sealing defects of the site concerned, as well as to the excessive flexibility of certain construction materials used, which, in the event of strong winds, give rise to pressure variations inside the room as a result of wind surge or air infiltration.

In order to do away with the alarm tripping which is not caused by a break-in, the sensitivity threshold of these detectors is set relatively high so that they do not react to such random and fugitive atmospheric disturbances which are unavoidable as they are the result of strong winds. This type of adjustment may reduce the detector's efficiency during calm weather.

In order to counter these drawbacks, the applicant developed a self-regulating alarm device described in European patent 0.317.459. In this device, an acoustic pressure differential detector features a sensitivity threshold which is constantly adjusted to its optimal value by the microphone's output signal which varies in accordance with the atmospheric disturbances that are detected at the microphone input.

Unfortunately, the device described in patent EP 0.317.459 relies upon analog electronic components such as capacitors and resistors whose characteristics vary from one component to another for the same type of component. This deviation in the characteristics for a given component, even if it is relatively low, may result in significant operational variations between two devices insofar as the operation of the device is based on the combination of a plurality of such components. In addition, this type of device generally has a permanent power supply and thus leads to excessive energy consumption due to the fact that it is connected to the mains in a wired alarm central station.

SUMMARY OF THE INVENTION

This is why the purpose of the invention is to supply self-adjusting alarm devices having insignificant operating variations from one device to another owing particularly to the fact that part of the device's functions is performed by a microprocessor.

Another purpose of the invention is to supply an alarm device of the type above having very low energy consumption owing to the use of a microprocessor.

Consequently, the invention concerns an alarm device featuring an acoustic pressure sensor supplying an analog signal to a first amplifying means and to a second amplifying means, a first comparator whereof the +input is connected to the output of the second amplifying means and whereof the output delivers a warning signal to alarm means when there is an actual break-in or a break-in attempt. This device includes self-adjusting means consisting mainly of an analog-digital converter, the input of which is connected to the output of the first amplifying means in order to supply at the output a digital signal that varies in accordance with the atmospheric disturbance and a microprocessor programmed to deliver, in response to the detection of the digital signal supplied by the converter, a digital signal at the −input of the comparator, whereof the pulses have a variable width which increases in accordance with the duration and the importance of the atmospheric disturbance so as to automatically increase the alarm device's triggering threshold and hence reduce its sensitivity when the acoustic sensor detects an atmospheric disturbance such as wind.

BRIEF DESCRIPTION OF FIGURES

The purposes, objects and characteristics of the invention will become more apparent from the following description when taken in conjunction with the accompanying drawings in which.

DETAILED DESCRIPTION OF THE INVENTION

Figure 1:
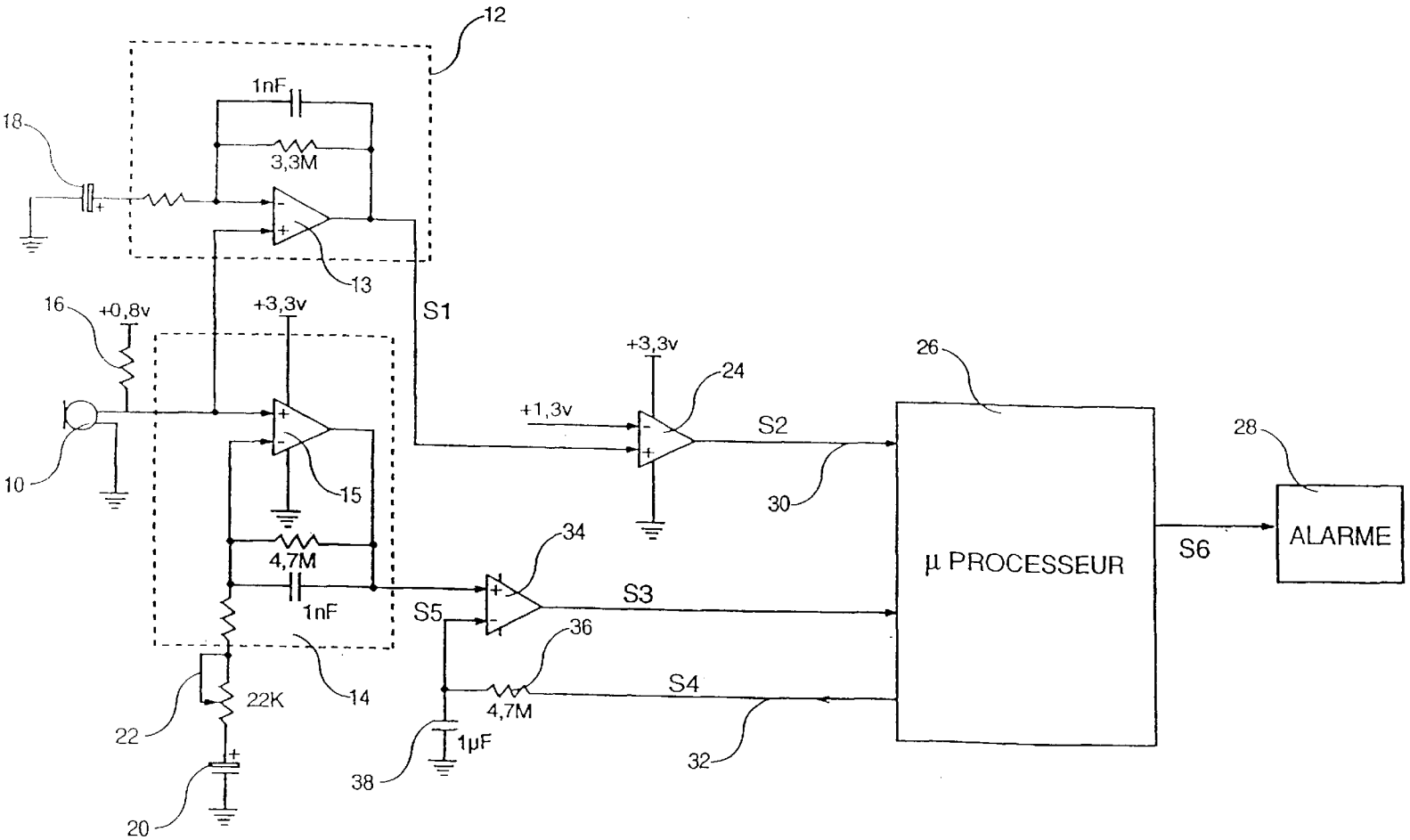
FIG. 1 is a block diagram of an alarm device according to the invention.

In reference to FIG. 1, the signals received by an acoustic sensor 10 such as a microphone are transmitted to the +input of an amplifying means with constant gain 12 and to the +input of an amplifying means with adjustable gain 14 through a resistor 16 connected to a 0.8 Volt source.

The amplifying means 12 primarily consists of an operational amplifier 13 featuring a resistor (3MΩ) and a capacitor (1 nF) between its −input and its output used as a counter reaction to limit the gain. The −input is connected to the ground by means of an electrolytic capacitor preventing the amplification of the off-load voltage.

The amplifying means 14 primarily consists of an operational amplifier 15 featuring a resistor (4.7MΩ) and a capacitor (1 nF) between its −input and its output used as a counter reaction to limit the gain. The −input is connected to the ground through an electrolytic capacitor 20 preventing the amplification of the off-load voltage and through a potentiometer 22 ranging from 210 to 10,000, the adjustment of which is performed according to the room in which the alarm device is installed, and the more hermetic said building is in terms of acoustics, the less the gain for the amplifier means is required.

The output of the amplifying means 12 is connected to the +input of a comparator 24 designed to transform the analog signal supplied by the amplifying means 12 into a binary signal whose width varies in accordance with the magnitude of the disturbance and which is transmitted to the microprocessor 26 in an attempt to self-adjust the alarm device.

Actually, when an atmospheric disturbance such as wind occurs, this disturbance induces a modulated signal at the output of the amplifying means 12, such a signal generally having a low frequency ranging between 10 and 20 Hz. This signal delivered to the +input of the comparator 24 results in a digital output signal at the output 30 of said comparator and thus at the input to the microprocessor 26. The latter, detecting a value 1 at the output 30 of the comparator 24 thus transmits, after a given time delay, digital pulses on the output line 32 which are intended to lower the device's sensitivity in order not to trip the alarm at an untimely moment in the case of a gust of wind, as will be discussed below. The value of the time delay may be set at 1 second so that if the signal received on the line 30 lasts longer than this time delay, the microprocessor 26 takes no action.

The output of the amplifying means 14 is connected to the +input of a comparator 34 which transforms the analog signal delivered by the amplifying means 14 into a binary signal which is transmitted to a microprocessor 26 in order to inform it of an untimely door opening or a break-in. When a signal corresponding to this type of event is recognized by the microprocessor 26, it transmits a signal to the alarm means 28 which is preferably a radio transmitter designed to transmit the alarm signal to the central alarm station.

As seen previously, the microprocessor 26 is programmed to transmit a signal on its output 32 when it detects a digital signal of value 1 on its input 30 coming from the comparator 24. This signal consists of pulses of variable length depending on the number and the width of the value 1 pulses detected on the input 30. In fact, supposing a sampling of 150 Hz of this input, an input bit of 15 Hz will thus be sampled approximately 5 times if the signal received is a perfect sine wave. With each sampling, the width of the pulse transmitted on the line 32 will be increased. In the same manner, this width is lowered every time the microprocessor detects the signal's 0 value on the line 30. We see that the more wind strength increases, wider the pulses transmitted at the output of the comparator 24 are and the wider the pulse delivered on the line 32 will be. Pulse width modulation is thus obtained.

The pulse transmitted on the line 32 charges the capacitor 38 (1 $\mu$F) (+or −) through a resistor 36 (4.7MΩ) and delivers a voltage whereof the value depends on the pulse width supplied on the line 32. The wider this pulse is, the higher the voltage supplied on the −input of the comparator 34 will be and the lower the sensitivity of the comparator 34 in order to react to the signal received from the sensor 10 to trigger the alarm 28. It should be noted that the duration during which the microprocessor 26 reacts to the presence of the atmospheric disturbance by transmitting increasingly wide pulses to the integrator 36–38 may be limited to a maximum value such as 10 or 20 seconds.

With the self-adjustment of the sensitivity threshold described above, it can be seen that if the wind turns into windstorm, the alarm is not triggered owing to the fact that the sensitivity threshold of the comparator 34 was increased automatically previously.

It should be noted that the manufacturing restrictions associated with the precision of the components as well as with the thermal deviations require that a margin be provided which decreases the sensitivity of the device in order to avoid untimely activation. This is why the device features a self-calibration function in the preferred embodiment. This takes place at the end of the initialization phase, after the device is switched on, and consists in searching for the width of the signal 32 for the microprocessor which enables the optimum sensitivity to be obtained. By making successive adjustments of the signal 32, it searches for the sensitivity level causing untimely actuation represented by a permanent signal 32. Periodic readjustments are required however, owing to possible thermal variations. To accomplish this, the microprocessor does this in two ways. If no incident occurs, it recalculates the optimal width of the signal 32 (every 30 min. for example). When an incident is detected, it checks that it is not an untimely activation by testing the sensitivity level before validating the incident.

Figure 2:
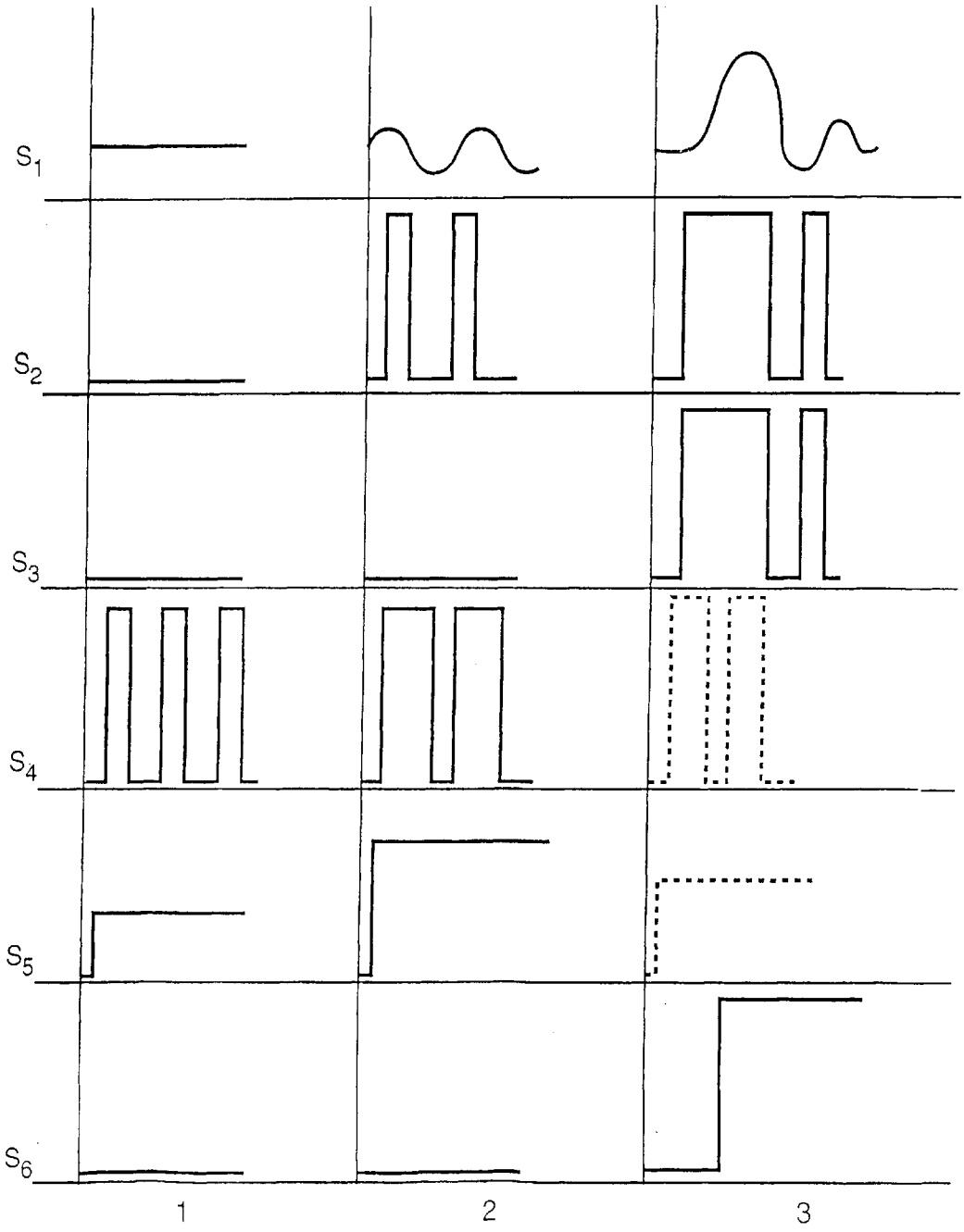
FIG. 2 is a diagram representing the signals observed at various points of the device when it is at rest, when it reacts to an atmospheric disturbance and when a break-in is detected.

The diagrams illustrated in FIG. 2 show the value of signals $S_1$ at the output of the amplifying means 12, $S_2$ at the output of the comparator 24, $S_3$ at the output of the comparator 34, $S_4$ on the line of output 32, $S_5$ at the input of the comparator 34 and $S_6$ at the output of the microprocessor 26 to the alarm 28, when (1) the device is at rest, (2) when an atmospheric disturbance occurs and (3) when a break-in occurs.

When there is no atmospheric disturbance (diagram 1), such as wind, or a break-in, the signal $S_1$ delivered by the amplifying means 12 has a constant value (0.8 volt) and the comparators 24 and 34 each supply a signal $S_2$ or $S_3$ which is nearly zero. In this case, the signal $S_4$ delivered by the microprocessor on the line 32 is a regular signal which enables a signal $S_5$ on the −input of the comparator to be obtained which is equal to approximately 1 volt. As the signal $S_3$ is reduced to 0, the same occurs with the alarm signal $S_6$.

If the wind picks up (diagram 2) the signal $S_1$ delivered to the output of the amplifying means 12 becomes approximately sinusoidal and the signal $S_2$ delivered to the microprocessor is formed by pulses of variable width depending on the strength of the disturbance. The signal $S_3$ is always nearly zero due to the fact that the sensitivity level was increased. The existence of pulses $S_2$ leads the microprocessor to generate pulses $S_4$ whose width depends on the width and number of pulses $S_2$, which results in a higher voltage signal $S_5$ (2 volts in this case) at the −input of the comparator 34. As previously, as the signal $S_3$ is reduced to 0, the same occurs with the alarm signal $S_6$.

When a break-in occurs (diagram 3), the signal $S_1$ is very high in terms of both width as well as amplitude without being sinusoidal. The signal $S_2$ at the output of the comparator 24 thus has a large pulse width. The same is true for signal $S_3$ at the output of the comparator 34, regardless of the sensitivity threshold set by the −input. As a result, signal $S_6$ adopts a high value following a predetermined time delay and thus triggers the alarm 28. It should be noted that signals $S_4$ and $S_5$ are not important in this case (shown in dashes) as the break-in is much greater than any possible disturbance.

It should be noted that the microprocessor's analysis of the width of the signal $S_3$ may enable the alarm signal supplied to be differentiated. It could thus be determined that, if this width is between a minimum width and a maximum width, it is an impact (against a window, for example) or a break-in attempt, while the break-in will only be recognized if this width is greater than the maximum width.

Modifications can be made to the description above without departing from the scope of the invention. In this manner, the comparator 24 may be replaced by an analog-digital converter enabling the supply of bit configurations associated with the signature of possible atmospheric disturbances, said configurations being analyzed and recognized by the microprocessor 26 before the latter transmits to its output 32 a signal $S_4$ which varies in accordance with the disturbance detected.

What is claimed is:

1. An alarm device comprising an acoustic pressure sensor supplying an analog signal to a first amplifier and to a second amplifier;

a first comparator having a positive input connected to an output of said second amplifier and wherein said first comparator's output delivers a warning signal to an alarm when there is a break-in or a break-in attempt;

self-adjusting means comprising an analog-digital converter having an input connected to an output of said first amplifier and wherein analog-digital converter's output is a digital signal which varies in accordance with an atmospheric disturbance, and a microprocessor programmed to deliver, in response to the detection of said digital signal supplied by said converter, a digital signal at a negative input of said first comparator, the pulses of which have a variable width which increases in accordance with the duration and the strength of said atmospheric disturbance so as to automatically increase a triggering threshold of said alarm and hence reduce its sensitivity when said acoustic pressure sensor detects an atmospheric disturbance.

2. The device of claim 1, further comprising a pulse converter connected to the negative input of said first comparator and which is capable of supplying a signal whose voltage varies according to the width vs time of said variable-width pulses.

3. The device of claim 2, wherein said pulse converter includes a capacitor charged by said variable-width pulses by a resistor in order to transform said variable-width pulses into a voltage signal, the value of which is proportional to their width vs time.

4. The device of claim 1, wherein said analog-digital converter delivers a configuration of bits associated with said atmospheric disturbance and said microprocessor is programmed to deliver an augmentation signal for the voltage applied to the negative input of said first comparator in accordance with said configuration.

5. The device of claim 1, wherein said analog-digital converter is a second comparator that supplies pulses whose width varies in accordance with the magnitude of said atmospheric disturbance.

6. The device of claim 1, wherein said alarm includes a microprocessor programmed to supply a voltage signal in response to said alarm signal whose width vs time exceeds a predetermined threshold and an alarm means which is activated upon detection of said voltage signal.

7. The device of claim 6, wherein said alarm means is activated differently depending upon whether the width of said alarm signal is between a minimum value and a maximum value indicating that a break-in attempt or impact has occurred, or said width is greater than said maximum value indicating that a break-in has occurred.

8. The device of claim 1, wherein said second amplifier comprises an operational amplifier and which has variable gain due to a potentiometer connected between the ground and a negative input of said operational amplifier.

9. The device of claim 1, wherein said microprocessor searches, by successive adjustments, for the optimum width of said variable-width pulses causing untimely triggering represented by a permanent signal at the time of device initialization.

10. The device of claim 7, wherein said microprocessor performs periodic readjustments by recalculating said optimal width when no incident is detected or by checking that it is not an untimely triggering by testing the sensitivity threshold when an incident is detected.

* * * * *

UNITED STATES PATENT AND TRADEMARK OFFICE

CERTIFICATE OF CORRECTION

PATENT NO. : 6,720,875 B2
DATED : April 13, 2004
INVENTOR(S) : Francois Phillippe It is certified that error appears in the above-identified patent and that said Letters Patent is hereby corrected as shown below:

Title page,
Item [30], insert the following:

-- [30] Foreign Application Priority Data
May 18, 2000 (FR)……..00/06360 --

Signed and Sealed this

Fourteenth Day of September, 2004

JON W. DUDAS
*Director of the United States Patent and Trademark Office*